US007377220B2

(12) United States Patent
Coudurier et al.

(10) Patent No.: US 7,377,220 B2
(45) Date of Patent: May 27, 2008

(54) OPERATING MECHANISM WITH LATCHING OF A PIVOTING COVER FOR A CHAIR-LIFT

(75) Inventors: Stéphane Coudurier, Grenoble (FR); Daniel Michel, Saint-Egreve (FR)

(73) Assignee: Pomagalski SA, Fontaine (FR)

( * ) Notice: Subject to any disclaimer, the term of this patent is extended or adjusted under 35 U.S.C. 154(b) by 249 days.

(21) Appl. No.: 11/249,716

(22) Filed: Oct. 14, 2005

(65) Prior Publication Data

US 2006/0131940 A1 Jun. 22, 2006

(30) Foreign Application Priority Data

Dec. 17, 2004 (FR) ..... 04 13501

(51) Int. Cl.
*B61B 7/00* (2006.01)

(52) U.S. Cl. ..... 105/149.2

(58) Field of Classification Search ..... 105/149.2, 105/149.1, 148, 150, 332, 341, 345; 104/173.1, 104/173.2

See application file for complete search history.

(56) References Cited

U.S. PATENT DOCUMENTS 4,303,016 A * 12/1981 Tauzin ..... 104/173.2

FOREIGN PATENT DOCUMENTS

| | | | |
|---|---|---|---|
| EP | A 510 357 | | 10/1992 |
| EP | 0 748 732 | A1 | 12/1996 |
| EP | 0 771 708 | A1 | 5/1997 |
| JP | 7-69209 | * | 3/1995 |

* cited by examiner

*Primary Examiner*—Mark Le
(74) *Attorney, Agent, or Firm*—Oliff & Berridge, PLC

(57) ABSTRACT

A chair for an aerial transport installation comprises a pivoting protective cover actuated by an operating mechanism with automatic latching of the cover in the closed position. An operating lever is pivotally mounted on a first pivoting spindle of the cover and operates in conjunction with a latch actuated by a cable transmission device between a latched position and an unlatched position. The latch comprises a first arm equipped with a latching nose and a second arm designed to come up against a first stop corresponding to the latched position or a second stop corresponding to the unlatched position. The latching zone is situated at the base of the shell, preferably in a gap situated between the first spindle and the second spindle.

8 Claims, 4 Drawing Sheets

OPERATING MECHANISM WITH LATCHING OF A PIVOTING COVER FOR A CHAIR-LIFT

BACKGROUND OF THE INVENTION

The invention relates to a chair for an aerial transport installation, in particular a chair-lift, comprising:

a support bow connected to a hanger arm, a pivoting cover for protection against inclement weather, which cover is formed by a shell made of transparent plastic material mounted swivelling around a first spindle of the bow between a raised open position and a lowered closed position, and an operating mechanism with automatic latching of the cover in said lowered closed position, said mechanism comprising an operating lever associated by a transmission device to an operating means controlled by actuating means provided in the terminal.

STATE OF THE ART

The document EP-A-510,357 describes an operating mechanism of a cover for a chair-lift or a cable car cabin wherein a latching ratchet is articulated directly on the operating means. The ratchet acts on a pin securedly fixed to the top part of the hanger arm, with a certain heightwise stagger with respect to the top of the shell when the latter is in the closed position. The transmission device is formed by an articulated rod mechanism that has to be arranged to transmit the movement of the operating means and the latching force coming from the ratchet to the shell. Such a mounting device of the ratchet on the operating means causes latching of the cover on the hanger arm right from the beginning of the kinematic control chain.

OBJECT OF THE INVENTION

The object of the present invention is to provide an operating mechanism of a pivoting cover for a chair-lift wherein the blocking action in the closed position takes place near to the cover so as to obtain positive latching without blocking the rest of the kinematic control chain.

The chair according to the invention is characterized in that the operating lever is mounted pivoting on the first pivoting spindle of the cover and operates in conjunction with a latch actuated by the transmission device between a latched position and an unlatched position.

According to a preferred embodiment of the invention, the latch is articulated around a second spindle situated on the bow above the first spindle. The latch comprises a first arm equipped with a latching nose operating in conjunction with a roller of the operating lever, and a second arm designed to come up against a first stop corresponding to the latched position, or a second stop corresponding to the unlatched position. The transmission device is formed by a flexible cable link housed in a sheath, the assembly being designed to transmit the movements of the operating means to the operating lever, and vice-versa.

In the closed latched position, only the shell is positively latched, but not the operating means and the transmission device of the kinematic chain. The latching zone is situated at the base of the shell, preferably in a gap situated between the first spindle and the second spindle.

Other features can be used alone or in combination:

the latching nose of the latch is arranged as a ratchet comprising an inclined ramp and a notch substantially perpendicular to the first arm;

the cable link is interconnected between the operating means and an intermediate attachment point of the operating lever;

the cable link slides in a sheath, which is securedly fixed to the hanger arm by attachment means, and to a rim of the latch;

the operating lever presents a jointed V-shape one of the ends whereof is articulated on the first spindle and the other end whereof bears the roller.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
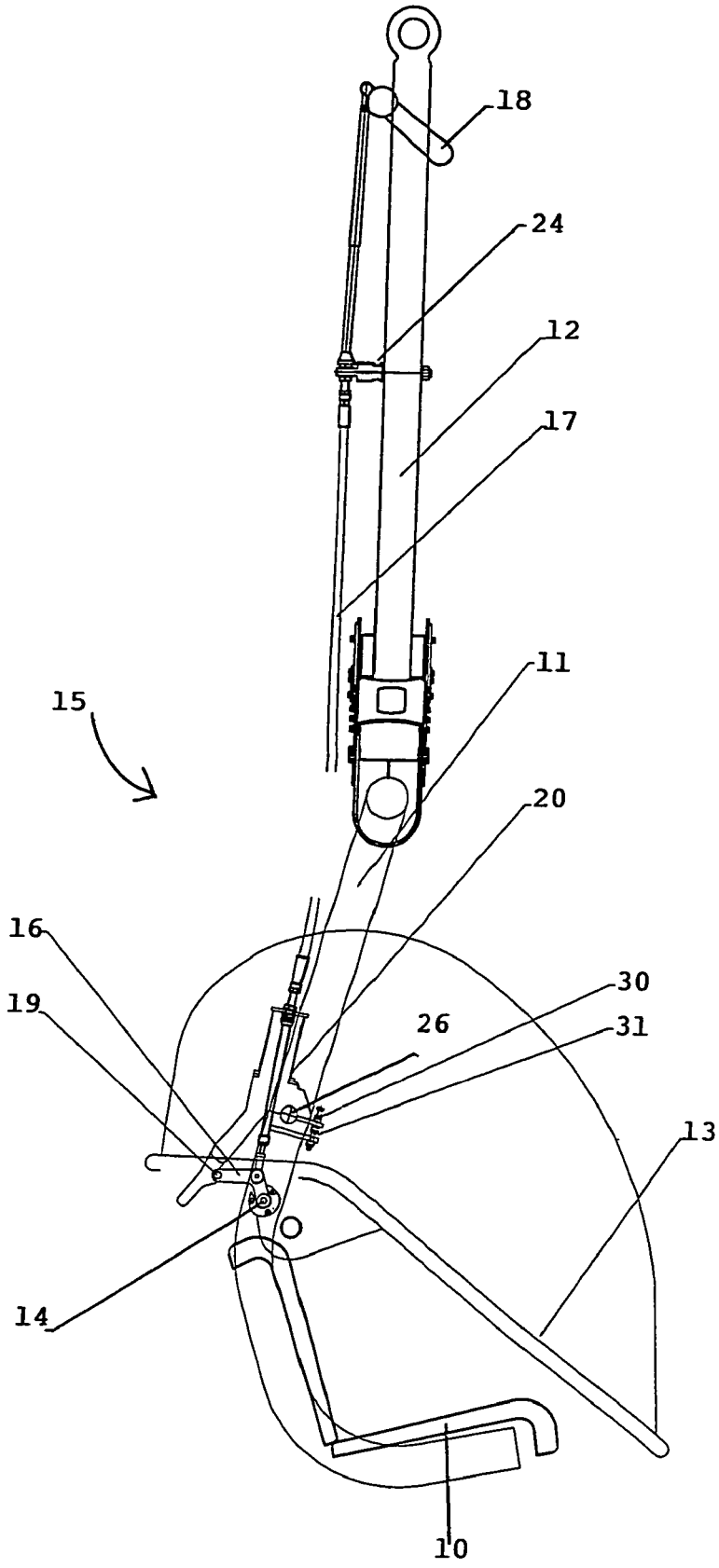
FIG. 1 is a schematic side view of a chair with a protective cover of an aerial transport installation, said cover being equipped with the operating mechanism with latching according to the invention.

With reference to the figures, each chair 10 of an aerial ropeway transport installation, in particular a chair-lift, is securedly fixed to a support bow 11 connected to a hanger bar 12 which is attached to the rope by a fastening clamp (not represented).

The chair 10 is equipped with a cover 13 formed by a protective shell made of transparent plastic material, for example polycarbonate. The cover 13 is mounted swivelling around a first transverse spindle 14 between a raised open position (FIG. 2) enabling free access to the chair 10, and a lowered closed position (FIG. 1) in which the shell covers the chair 10 to protect the people against inclement weather. Opening and closing of the cover 13 are performed manually or automatically on arrival and departure from the terminal.

The cover 13 is coupled to an operating mechanism 15 comprising an operating lever 16 associated with an operating means 18 by means of a transmission device 17. The operating lever 16 presents a jointed V-shape and is mounted at one of its ends on the pivoting spindle 14 of the shell. A roller 19 is arranged at its opposite end to operate in conjunction with an articulated latch 20.

The operating means 18 is formed for example by a lever able to pivot due to the action of a ramp placed at a predetermined place of the terminal to command automatic closing or opening of the cover 13.

The transmission device 17 is formed by a cable link 21 able to slide in a sheath 22 to transmit movements of the operating means 18 to the operating lever 16, and vice-versa. The cable link 21 is interconnected for this purpose between the operating means 18 at the top part of the hanger arm 12 and an intermediate attachment point 23 of the operating lever 16. The sheath 22 is securedly fixed to the hanger arm 12 by at least one securing hoop 24, and to a rim 25 of the latch 20.

The latch 20 is mounted with limited pivoting around a second spindle 26 situated on the bow 11 above the first spindle 14. The latch 20 comprises a first arm 27 equipped with a latching nose 28 and a second arm 29 designed to operate in conjunction with a first upper stop 30 or a second lower stop 31 to determine the angular pivoting travel of the latch 20.

The latching nose 28 is advantageously shaped as a ratchet comprising an inclined ramp and a notch substantially perpendicular to the first arm 27. The latch 20 is actuated by the cable link 21 between a latched position and an unlatched position.

Operation of the operating mechanism 15 with latching of the cover 13 according to the invention is as follows:

Manual Closing

Figure 2:
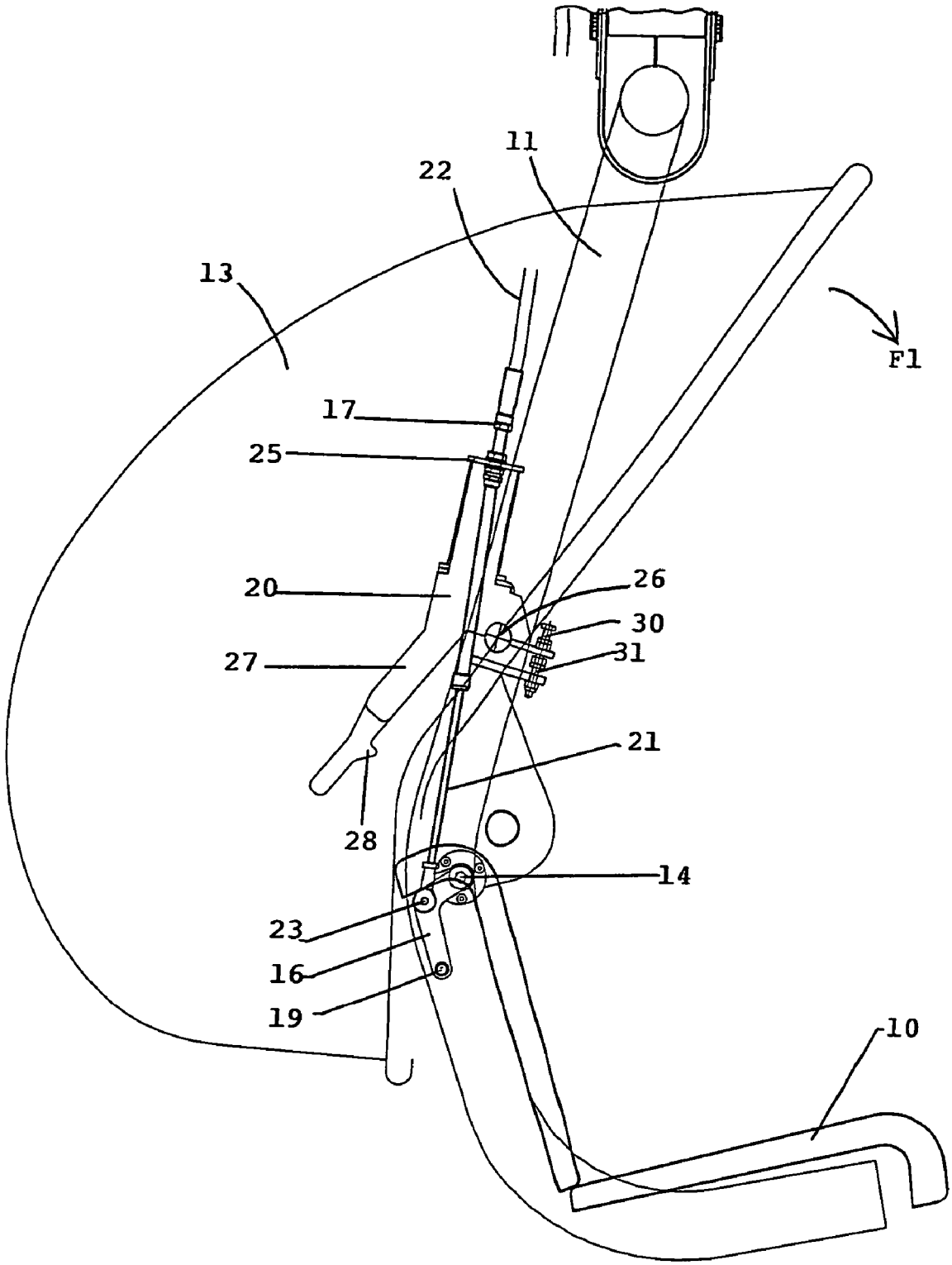
FIGS. 2 to 4 show enlarged scale views of the cover, which is represented respectively in the open position, the closed unlatched position, and the closed latched position.
Figure 3:
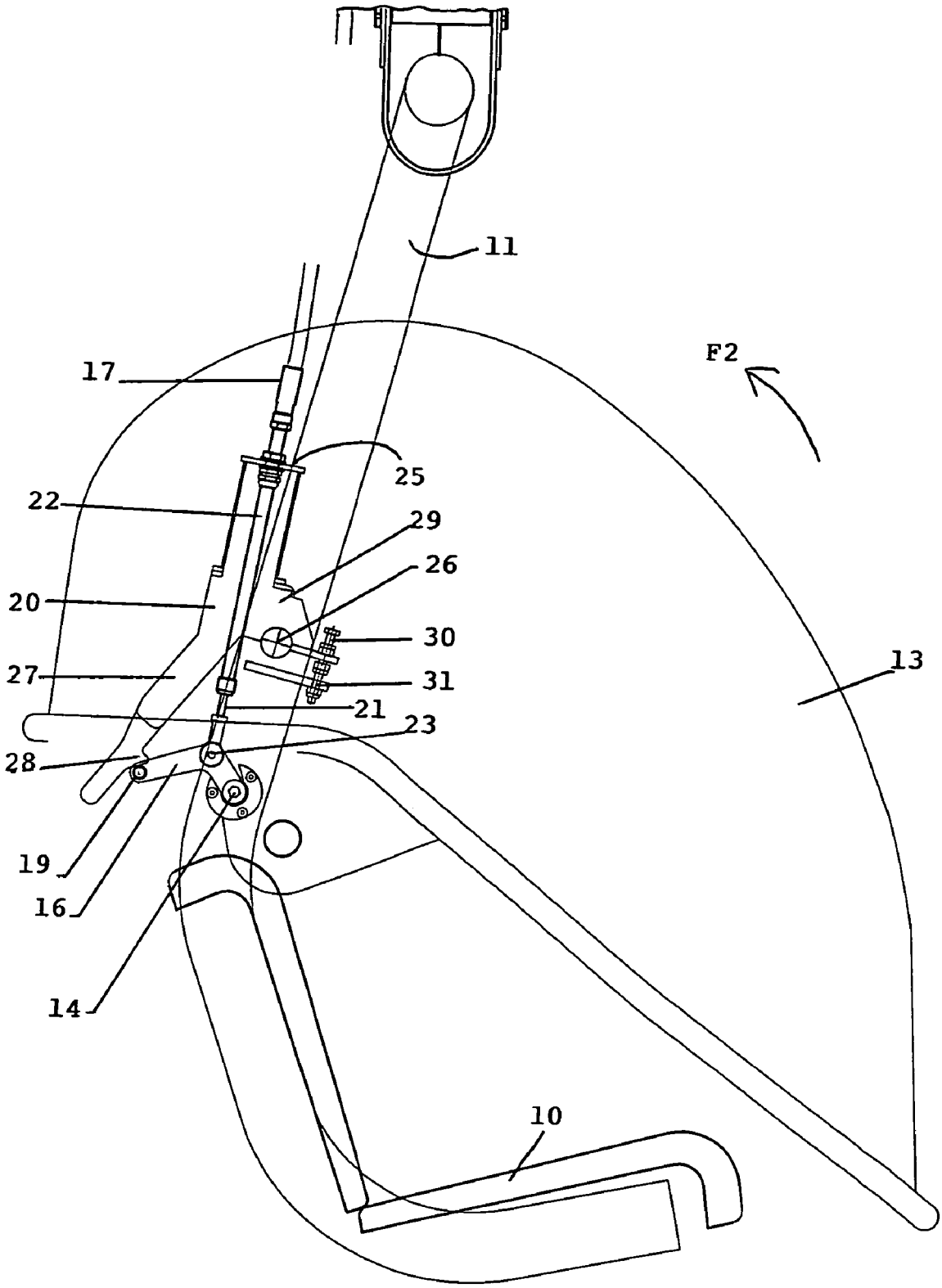

Manual closing is performed by a person sitting on the chair 10 who lowers the cover 13 making it swivel in the clockwise direction (arrow F1) from the open position (FIG. 2) to the unlatched closed position of FIG. 3. The swivelling movement of the shell makes the operating lever 16 pivot in the same direction, the latter transmitting the movement to the cable link 21. On account of the internal friction effect of the cable 21 in the sheath 22, a reaction is exerted in the upward direction on the rim 25 making the latch 20 pivot clockwise until the second arm 29 comes into engagement against the second lower stop 31. The latch 20 remains in this position and the roller 19 of the operating lever 16 is pressing on the ramp of the latching nose 28 without clipping into the notch. The cover 13 is closed but not latched.

Automatic Closing

Figure 4:
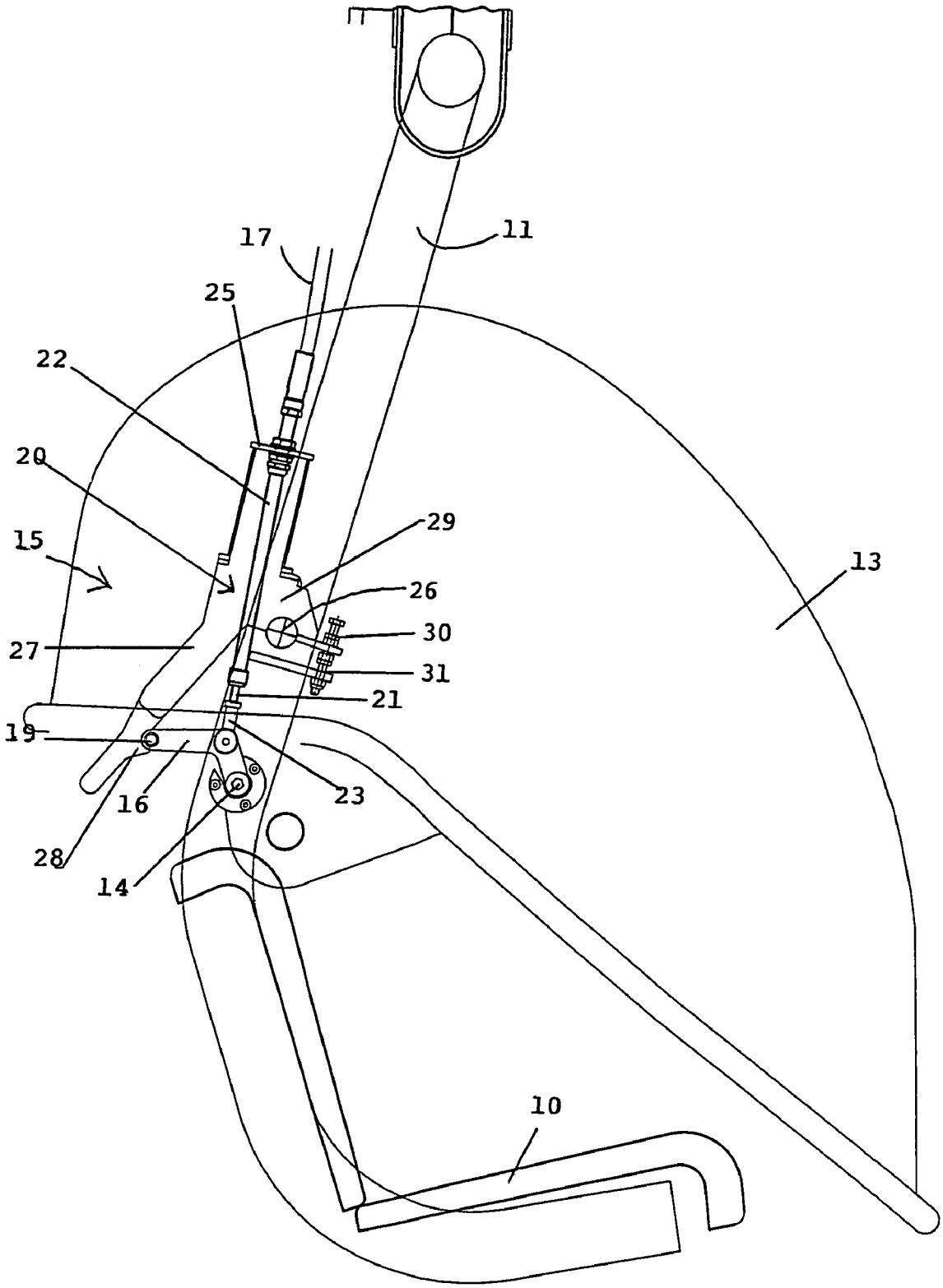

Automatic closing of the shell is performed following pivoting of the operating means 18 resulting in a thrust on the cable link 21. A downward reaction exerted by the sheath 22 is transmitted to the latch 20 which pivots counterclockwise and comes up against the first upper stop 30. The operating cable 21 transmits the movement simultaneously to the operating lever 16, which makes the shell swivel in the closing direction. When the operating lever 16 comes into contact with the latch 20, the roller 19 rolls on the ramp of the latching nose 28 and drives the latch 20 down to the second lower stop 31. The roller 19 passes the neck of the ramp and drops into the notch of the latch 20. The force exerted by the sheath 22 makes the articulated latch 20 return to the first upper stop 30, in which the shell is latched in the closed position (FIGS. 1 and 4). In this position, only the shell is positively latched, but not the operating means 18 at the beginning of the kinematic chain. The latching zone is situated at the base of the shell, preferably in a gap between the two spindles 14, 26.

Manual Opening

Manual opening is possible from the closed unlatched position of FIG. 3. The shell merely has to be lifted up in the direction of the arrow F2 to move the pivoting operating lever 16 in the same direction. The latch 20 is pressing up against the first upper stop 30 and the opening movement takes place freely up to the end of travel of the shell.

Automatic Opening

Automatic opening is performed by means of the operating means 18 from the closed latched position illustrated in FIGS. 1 and 4. A traction exerted on the cable 21 causes a reaction of the sheath 22 on the rim 25 making the latch 20 pivot clockwise. The latch 20 coming up against the second lower stop 31 releases the roller 31 from the notch and unlatches the operating lever 16, which in turn drives the shell to the end of opening travel position (FIG. 2).

The invention claimed is:

1. A chair-lift for an aerial transport installation, the chair-lift comprising:

a support bow connected to a hanger arm;

a pivoting cover for protection against inclement weather, which cover is formed by a shell made of transparent plastic material mounted to swivel around a first spindle of the bow between a raised open position and a lowered closed position;

an operating mechanism with automatic latching of the cover in said lowered closed position, said mechanism comprising an operating lever associated by a transmission device to an operating means, wherein the operating lever is pivotally mounted on the first pivoting spindle of the cover and operates in conjunction with a latch actuated by the transmission device between a closed latched position and an unlatched position, and the latch has a latching zone that is situated at a base of the shell when the cover is in the closed latched position.

2. The chair-lift according to claim 1, wherein the latch is articulated around a second spindle situated on the bow above the first spindle.

3. The chair-lift according to claim 2, wherein the latch comprises:

a first arm equipped with a latching nose operating in conjunction with a roller of the operating lever, and a second arm designed to come up against a first stop corresponding to the closed latched position, or a second stop corresponding to the unlatched position.

4. The chair-lift according to claim 3, wherein the latching nose is arranged as a ratchet comprising an inclined ramp and a notch substantially perpendicular to the first arm.

5. The chair-lift according to claim 1, wherein the transmission device is formed by a cable link designed to transmit the movements of the operating means to the operating lever, and vice-versa.

6. The chair-lift according to claim 5, wherein the cable link is interconnected between the operating means and an intermediate attachment point of the operating lever.

7. The chair-lift according to claim 5, wherein the cable link slides in a sheath, which is securedly fixed to the hanger arm by attachment means, and to a rim of the latch.

8. The chair-lift according to claim 3, wherein the operating lever presents a jointed V-shapes one of the ends thereof is articulated on the first spindle and the other end thereof bears the roller.

* * * * *